United States Patent [19]

Mayer et al.

[11] 4,066,059

[45] Jan. 3, 1978

[54] FUEL INJECTION NOZZLE VALVE AND IGNITION SYSTEM

[75] Inventors: Edward A. Mayer, Newburgh; Jerry L. Nolting, Fishkill, both of N.Y.

[73] Assignee: Texaco Inc., New York, N.Y.

[21] Appl. No.: 645,963

[22] Filed: Jan. 2, 1976

[51] Int. Cl.[2] ..... F02B 3/00; F02P 5/04

[52] U.S. Cl. ..... 123/32 SA; 123/32 AE; 123/148 E; 123/152

[58] Field of Search ..... 123/146.5 A, 152, 153, 123/32 JV, 117 R, 151, 156, 163, 32 AE, 325 A; 239/533

[56] References Cited

U.S. PATENT DOCUMENTS

| | | | |
|---|---|---|---|
| 1,387,166 | 8/1921 | Pazos | 123/152 |
| 1,547,030 | 7/1925 | Castillo | 123/152 |
| 3,259,118 | 7/1966 | Peters | 123/148 E |

FOREIGN PATENT DOCUMENTS

| | | | |
|---|---|---|---|
| 2,305,114 | 8/1974 | Germany | 123/32 JV |

*Primary Examiner*—Ronald B. Cox

*Attorney, Agent, or Firm*—Thomas H. Whaley; Carl G. Ries; Henry C. Dearborn

[57] ABSTRACT

A nozzle valve of the type for fuel injection in an internal combustion engine. It has a needle and a valve seat adjacent to one end of the needle, plus a spring to bias the needle against the seat. It also has means for lifting the needle off the seat when the spring bias is exceeded. And, it includes means actuated by the needle lift to initiate an electric spark signal.

4 Claims, 6 Drawing Figures

69
71
68
67
63
64
12
59
54
52
53
58
60
50
49
11
34
31
30
27
23
24
72
73
36
28
13
14
40
45
41
39
21
19
18
20
44
48
38
39a
18a
118
123
119
120

FUEL INJECTION NOZZLE VALVE AND IGNITION SYSTEM

BACKGROUND OF THE INVENTION

1. Field of the Invention

This invention concerns a system that relates to internal combustion engines in general. More specifically, the system is applicable to an internal combustion engine of the type that employs fuel injection and in addition includes electric spark ignition.

2. Description of the Prior Art

There is a known type of internal combustion engine that employs fuel injection and in addition makes use of an electrical spark for igniting the fuel. Such an engine which is of the reciprocating piston type, has been found to have a problem in connection with the control of spark timing as it is applied to ignition of the fuel at the proper time in the engine cycle.

Thus, engines of the type disclosed in prior U.S. Pat. Nos. 2,484,009 and 2,718,883, have controlled timing of the spark signal by means of the fluid pressure being applied in the fuel injection system. This was done because it was recognized that the conventional timing, i.e. as taken from the crank shaft angle of the engine (where carburization of the fuel is employed) does not provide the basis for timing which is most important for the fuel injection type engine. However, it may be noted that those systems made use of various arrangements which depend upon the pressure of the fuel as it was developed by the fuel injection pump, for controlling the timing of the spark signal.

It has been found that such prior arrangements had an inherent time delay so that control of spark timing was apt to stray from the optimum desired instant.

Consequently, it is an object of this invention to provide a system including a fuel injection valve, that directly actuates the control of generating a spark signal.

SUMMARY OF THE INVENTION

Briefly, this invention concerns a nozzle valve for use in internal combustion engines employing electrical spark ignition and fuel injection. It comprises in combination a needle, and an valve seat at one end of the needle. It also comprises means for biasing said needle against said valve seat, and means for lifting said needle off said seat when said fluid pressure exceeds a predetermined amplitude. It also comprises means actuated by said needle lift for initiating an electric spark signal.

Again briefly, the invention concerns a nozzle valve for use in internal combustion engines employing electric spark ignition and fuel injection. It comprises in combination a needle constructed of electrically conductive material, and a valve seat constructed of electrically conductive material and located adjacent to one end of said needle. It also comprises spring means for biasing said needle against said valve seat, and means for lifting said needle off said seat when said fluid pressure exceeds a predetermined amplitude. In addition it comprises means actuated by said needle lift for initiating an electric spark signal. The last named means comprises means for insulating said needle from said nozzle valve body, and an ignition coil primary winding in addition to a relatively high power circuit comprising a transistor with said primary winding in the collector-emitter circuit thereof. The means actuated by said needle lift, also comprises a relatively low power circuit which in turn comprises a transistor with said needle in the base circuit thereof, and an intermediate power circuit comprising at least one transistor for interconnecting said high and low power circuits.

Again briefly, the invention is in combination with an ignition system for an internal combustion engine that employs fuel injection. It is also in combination with an ignition coil having a high tension secondary winding for generating spark signals, and a low tension primary winding for inducing said generation of spark signals, and also circuit means connected to said primary winding for controlling cut off of a DC current therein. The said circuit means comprises a fuel injection valve having a closed position and an open position, and electric circuit means integral with said valve for controlling said DC current cut-off when said valve goes from said closed to said open position.

Once more briefly, the invention is in combination with an ignition system for an internal combustion engine that employs fuel injection, and an ignition coil having a high tension secondary winding for generating spark signals and a low tension primary winding for inducing said generation of spark signals. It is also in combination with a distributor connected to said high tension secondary winding, and circuit means connected to said primary winding for controlling cut-off of a DC current therein. The said circuit means comprises a fuel injection valve having an electrically conductive needle, and an electrically conductive valve seat adjacent to one end of said needle. It also has means for electrically insulating said needle, and means for biasing said needle against said valve seat. In addition, it has means for lifting said needle off said seat when said fuel injection pressure exceeds a predetermined amplitude, and means for making an electrical circuit connection to said insulated needle. It also has a high power transistor in series with said primary winding, and a low power transistor controlled by said needle and valve seat. In addition, it has at least one additional transistor for coupling said low power transistor to said high power transistor. The said circuit means also comprises a plurality of said fuel injection valves, one for each cylinder of said engine.

BRIEF DESCRIPTION OF THE DRAWINGS

The foregoing and other objects and benefits of the invention will be more fully set forth below in connection with the best mode contemplated by the inventor of carrying out the invention, and in connection with which there are illustrations provided in the drawings, wherein.

DESCRIPTION OF THE PREFERRED EMBODIMENTS

It has been observed that in connection with internal combustion engines of the reciprocating type which use fuel injection and which in addition employ electrical spark ignition, the optimum or ideal would be to have a spark created only at the time when fuel arrives at the spark plug. Heretofore, the spark signal has been created under control of the action of a fuel pump, or the fuel pressure adjacent to such pump, and consequently it has been difficult to approach the ideal condition. By means of this invention the ideal may be substantially realized, while at the same time the principal elements of a conventional simple spark-coil ignition system may be utilized.

Figures 1, 2, 3, 4:
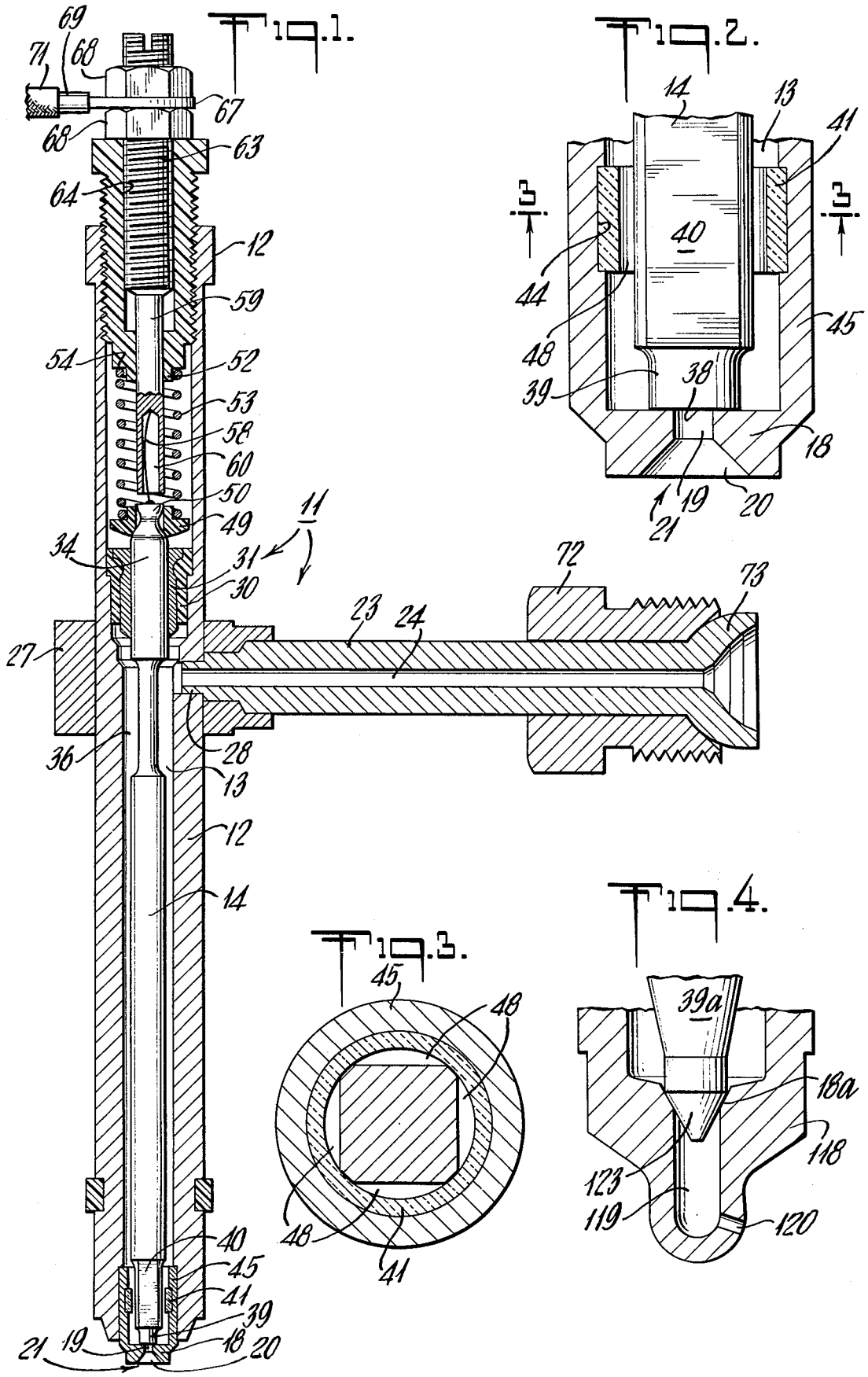
FIG. 1 is a longitudinal cross-section view showing a needle valve according to the invention.
FIG. 2 is a fragmentary enlarged view of the valve seat end of the valve that is illustrated in FIG. 1.
FIG. 3 is a cross-section view taken along the lines 3—3 of FIG. 2.
FIG. 4 is a similar fragmentary enlarged view like FIG. 2, but illustrating a modified form of valve seat and nozzle structure for a valve according to the invention.

With reference to FIGS. 1, 2 and 3, there is illustrated a nozzle type injection valve 11. It has a metallic body 12 that has a hollow interior 13 with an axially mounted needle 14 therein.

At the lower end (as viewed in FIG. 1) of the needle 14 there is a valve seat 18. This is made of an electrically conductive material, and it is securely mounted at the lower end of the housing, or body 12 of the valve 11. Seat 18 has an orifice 19 which joins a flaired frusto conical section 20. Together, the parts 19 and 20 form a nozzle 21 through which the fuel flows under pressure when the needle 14 is lifted off the flat face of the seat 18.

Fuel is introduced into the interior 13 of the valve body 12 in any feasible manner. For example, the FIG. 1 illustration shows a laterally connected tube 23 that has an interior passage 24 therein, through which the liquid fuel is introduced.

The tube 23 is connected to the interior 13 of the valve 11 in a pressure tight manner. Thus for example, it has an annular connecting piece or clamping rings 27 that surrounds the outside of the body 12 of the valve 11. This holds the tube 23 securely in place with a smaller diameter end 28 thereof passing through the side wall of the body 12 so that the passage 24 is connected with the interior 13 of the valve 11.

At the upper end of the needle 14 (as view in FIG. 1) there is a sleeve 30 that is made of electrically insulating material. It is mounted securely in a fluid pressure-tight manner, within the body 12 of the valve 11. The sleeve 30 also surrounds and holds in place an inner metallic sleeve 31 that makes a pressure-tight sliding fit with an upper cylindrical portion 34 of the needle 14.

In between the upper portion 34 and the main body of the needle 14, there is a reduced diameter connecting section 35. This creates an annular chamber 36 which assists in providing an unimpeded connection with the passage 24 that carries the fuel from the fuel pump (not shown). The upper end of the chamber 36 is enlarged in order to create an adequate reservoir of fuel. And, the dimensions of the needle 14 are designed to create a lifting force on the needle to open the valve at the nozzle 21.

At the lower end (as viewed in FIGS. 1 and 2) of the needle 14 there is a flat face 38 that contacts the parallel flat surface of the valve seat 18 when the needle 14 is in its spring biased position, as illustrated in FIGS. 1 and 2. It will be observed that there is a reduced diameter tip portion 39 on the needle 14, so that the hydraulic pressure applied via the fuel in line 24 and interior space 13, will tend to lift the needle 14.

Just above the reduced diameter tip 39 of the needle 14, there is a rectangular section 40 with rounded corners that is supported for vertical sliding movements within a guide 41. This guide 41 is a short cylindrical sleeve or ring which is securely mounted in an inset, or recess 44 which is cut into the inner walls of a metallic body 45 which is an integral part with the valve seat 18.

It will be noted that the rounded corners of the flat faces of rectangular section 40 are concentric with the needle 14 and have an outside diameter which makes a sliding fit with the inside diameter of the guide ring 41.

It will be observed that the flat faces of rectangular section 40 on the needle 14, form passage ways 48 where the liquid fuel may flow through. Also, it should be noted that the guide ring 41 is an electrically insulating type of material, so that the needle 14 does not make electrically conductive contact with the metallic body 12 except at the face 38 of the tip 39 of the needle where it comes in contact with the valve seat 18.

At the upper end (as viewed in FIG. 1) of the needle 14, i.e. at the top of upper section 34, there is a grommet 49 that has a tapered hole which fits over and contacts a necked in end portion 50 of the needle 14. The grommet 49 has a flange for supporting one end of a coil spring 53 that the other end fitted over a reduced diameter end 52 which forms a shoulder 54. The reduced diameter end 52 and shoulder 54 are formed at the lower end (as viewed in FIG. 1) of an electrically insulating material part 57 that is threaded into place in the upper end (as view in FIG. 1) of the body 12 of the valve 11. The spring 53 provides spring bias force for holding the needle 14 in closed position against the valve seat 18, at the nozzle valve end thereof.

In order to complete an electrical circuit which includes the needle 14, there is a flexible electrical conductor 58 that is welded or otherwise securely fastened onto the upper end (as viewed in FIG. 1) of the needle 14. The other end of conductor 58 is fastened securely (for good electrical contact) with a metallic rod 59. The connection is made at the base of a recess 60 which is axially bored into the free end of the rod 59. The rod 59 is integrally joined to an enlarged threaded portion 63 that screws into a threaded interior bore 64 of the insulating part 57.

An electrical circuit which includes the needle 14 and the flexible conductor 58 as well as the rod 59, is continued via contact lug 67 that is clamped between a pair of nuts 68 which are screwed onto the threaded portion 63 of the rod 59. Of course, the lug 67 has a tab 69 extending radially from the lug 67. The tab 69 may be crimped into, or otherwise securely fastened to a wire 71. This wire 71 is part of an electrical circuit for controlling the generation of a spark signal, as will appear in greater detail below.

It will be understood that the tube 23 is arranged for being fastened in a fluid tight manner to the fuel pump outlet, in any feasible manner. For example, there is a threaded hexagonal nut 72 that is located outside of the tube 23. It has a concave tapered end for contacting an enlarged end 73 of the tube 23. Of course those elements which are for carrying the fuel to the interior of the valve 11, will be designed so as to have dimensions as required for a particular engine.

Figure 5:
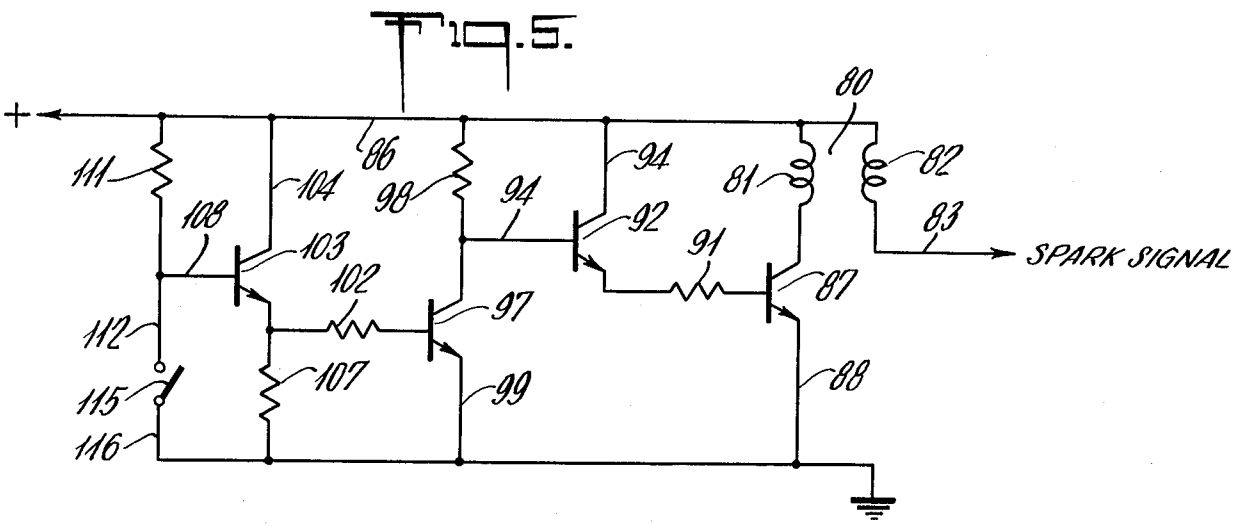
FIG. 5 is a schematic circuit diagram illustrating an electrical ignition system according to the invention.

FIG. 5 illustrates a circuit diagram for an ignition system that may be employed in combination with this invention. There is a conventional ignition coil 80 that is schematically indicated with a low tension primary winding 81 and a high tension secondary winding 82.

There is also, of course, an output circuit connection 83 that is connected to the free end of the high tension coil 82 and carries high voltage spark signals to one or more spark plugs (not shown). It will be understood that these are the elements of an ignition coil which may be conventional like the type ordinarily employed with internal combustion reciprocating type engines.

The low tension primary winding 81 has one end connected to a DC source via a common circuit connection 86. This connection usually goes to a battery (indicated by the plus sign) via a key operated ignition switch (not shown). The other end of the primary winding 81 is connected directly to the collector electrode of a power transistor 87, and the emitter electrode of the transistor 87 is connected to ground via a circuit connection 88, as indicated.

The base electrode of transistor 87 has a connection via a resistor 91 to the emitter electrode of an intermediate power transistor 92. The collector electrode of transistor 92 is connected via a circuit connection 93 to the common connection 86 of the DC voltage supply.

The base electrode of the transistor 92 is connected via a circuit connection 94 to the output circuit of another intermediate power transistor 97. That output circuit includes a resistor 98 that is connected in series with the transistor 97 between the positive voltage connection 86 and the collector electrode of transistor 97. The emitter electrode of transistor 97 is connected to ground via a circuit connection 99, as indicated.

The base electrode of transistor 97 is connected via a resistor 102 to the output circuit of a low power transistor 103. The output circuit for this transistor 103 includes a circuit connection 104 from the DC common voltage connection 86 to the collector electrode of transistor 103. The emitter electrode of transistor 103 is connected to one end of a resistor 107 that has the other end thereof connected to ground, as indicated.

The input circuit for the transistor 103 is connected to the base electrode there of via a circuit connection 108. Connection 108 goes to one end of a resistor 111 which has the other end thereof connected to the common DC voltage supply circuit 86. Also there is a switch 115 that is connected to the base electrode of transistor 103 via a circuit connection 112 and to ground via a connection 116, as indicated.

The switch 115, that is a schematic representation in FIG. 5, represents the elements (electrically speaking) of the needle valve 11. Thus, the side of the switch 115 that is connected to ground via the circuit connection 116 includes the metallic body portion 12 with the valve seat 18 electrically connected thereto. The metallic parts of the valve 11 are connected electrically to grounded parts of the engine, in a conventional matter.

In other words, when the valve 11 is in its closed position, as illustrated in FIG. 1, the switch 115 is closed. However, at the time when the fuel pressure exceeds the spring bias force of spring 53, the switch 115 is opened.

It will be understood that the operation of the electrical system is similar to a conventional system employing breaker points. Therefore during the intervals between spark signals, the switch 115 (i.e. valve 11) will be closed and the transistor circuits will cause steady state DC current flow through the primary winding 81 which is in series with the power transistor 87. When a spark signal is called for, the switch 115 is opened and the DC current flowing through primary winding 81 is cut off. Such cut-off creates a decaying magnetic field that generates a high voltage spark signal in the high tension winding 82.

Operation

With reference to the above described injection valve 11 and the ignition system illustrated in FIG. 5, a review of the operation may be helpful. It will be appreciated by one skilled in the art that the fuel pressure is developed in a conventional manner in regard to fuel injection systems as used with internal combustion engines of the reciprocating type. Thus, a cam actuated fuel pump applies a peak pressure on the order of 3500 pounds per square inch, at the time when injection takes place for a given cylinder of the engine. Such fuel pressure increase is applied to the fuel in tube 24, which is in direct connection with the interior, or annular space 13 in the body 12 of the valve 11. The fuel pump is of course connected to the crank shaft of the engine, so that the fuel injection pressure may be developed at the instant it is desired for injecting the fuel into the cylinder. This pressure increase acts upon the needle 14 to lift it against the spring bias force that is created by the spring 53. The lifting pressure is, of course, created by the differential in forces applied to the needle 14 longitudinally, due to the reduced diameter at the tip 39.

When the needle 14 is raised, the flat face 38 at the tip there of, is lifted off of its seating contact with the valve seat 18. Then, of course when the valve opens, the fuel is injected under high pressure into the cylinder through the nozzle that is formed by orifices 19 and 20. This injection takes place with desired atomization of the fuel, due to the hydraulic flow conditions under high pressure.

At the same instant when fuel is being injected through the nozzle, the lifting of the needle 14 and its tip 39 (flat face 38) off of the valve seat 18 will cause a break in the electrical circuit that was indicated above. This break is the opening of the switch 115 described in FIG. 5. Consequently, the electrical circuit action may be traced as follows.

Opening of the switch 115 will cause the low power transistor 103 to conduct. This in turn will cause the intermediate transistor 97 to conduct. Transistor 97 has its' output circuit connected to transistor 92 in such manner that the transistor 92 will be cutoff. Then, by means of the circuit which is known as a Darlington connection, the high power transistor 87 will also be cutoff, so that the steady state DC current flowing through transistor 87 and primary winding 81 will be cutoff. The later will cause a decay of the magnetic field created by the winding 81 so that a spark signal will be developed in the output winding 82.

It may be helpful to note in connection with the mechanical description of the valve 11, that the corresponding electrical circuit elements shown in the FIG. 5 circuit are as follows. Starting at the valve seat 18, the metallic body portion 45 of the nozzle structure that incorporates the valve seat 18 is connected into the body 12 which is grounded to the engine. These elements are represented by the circuit connection 116 of FIG. 5.

Similarly, the needle 14 and integral parts 35, 34 and 50 thereof plus the flexible connector 58 and the rod 59 and the lug 67 with the connected wire 71, are represented by the circuit connection 112. And, of course the valve seat 18 plus the flat face 38 of the tip 39, are represented by the switch 115. Thus, it will be understood that the desired spark signal will be generated at the instant when the valve 11 is opened by reason of the lifting of needle 14 (with its tip 39) from the valve seat 18.

Modifications

FIG. 4 illustrates a modification of the nozzle structure for the injector valve 11. Thus, instead of a flat faced valve structure as shown and described in FIGS. 1, 2 and 3, it may be preferable to employ a tapered tip on the needle with a so-call sac tip nozzle. This is illustrated in FIG. 4 which shows a valve seat 18*a* that is a tapered surface within an enclosed body 118 which is in place of the body 45 that incorporates the seat 18 of the other modification. Below the seat 18*a* there is an enclosed chamber 119 from which there is a port or nozzle opening 120. Also, it will be noted that there is a tip 39*a* on the needle. This is preferably tapered for this modification in order to accomodate a pointed end or face element 123 which seats against the tapered valve seat surface 18*a*.

It will of course be clear that the electrical switch action is substantially identical with that described above relative to FIGS. 1, 2 and 3. The FIG. 4 modification is merely a different type of nozzle valve which is employed in injecting the fuel.

Figure 6:
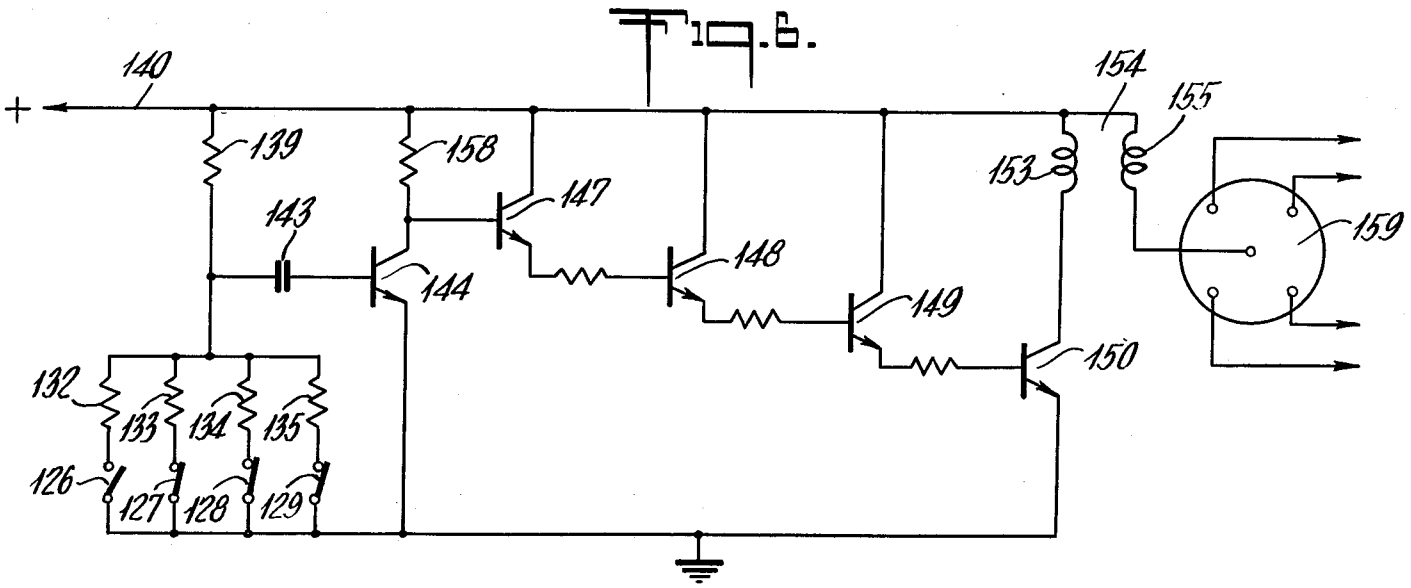
FIG. 6 is another schematic circuit diagram which illustrates a modification of an electrical ignition system according to the invention, as it is applied to a multi-cylinder engine.

FIG. 6 illustrates a modified electrical circuit arrangement. It is applicable to a multi-cylinder engine, e.g. one with four pistons and cylinders.

There are four switches 126–129, each of which will be embodied by a valve 11 as described above. Of course, as the engine is operated, only one of these valves will be lifted at a time, and consequently the electrical spark signal will be generated which corresponds to that valve opening. These signals will be generated in sequence in the usual manner for a reciprocating type internal combustion engine.

The rest of the electrical system of FIG. 6 includes a group of four resistors 132, 135, one for each of the switches 126–129. One end of all the resistors 132–135 is connected in common to a circuit connection 138 that goes to one end of a resistor 139 that has the other end thereof connected to common connection 140. Connection 140 goes to a steady state DC source, as indicated.

There is a capacitor 143 that is connected between the base electrode of a low power transistor 144, and the circuit connection 138 from the network of resistors 132–135.

The output circuit of transistor 144 is connected to a series of intermediate power, Darlington connected transistors 147, 148 and 149. These control a high power transistor 150 which is connected in a series circuit with a primary winding 153 of a spark coil 154. Coil 154 has a secondary, or high tension winding 155.

The output circuit of the low power transistor 144 includes a resistor 158 that is in series with the collector emitter circuit of transistor 144. The collector of transistor 144 is also connected to the base electrode of the transistor 147.

Also, it may be noted that the intermediate power transistor 147, 148 and 149 are connected together in the well known Darlington type circuit. This has the emitter of each of the transistors connected to the base of the next through a resistor, as indicated.

The output circuit of the high tension winding 155 goes to a distributor 159 which acts in a conventional manner to direct each spark signal to the desired cylinder where the fuel injection is taking place.

The operation of the FIG. 6 circuit is substantially like that described in FIG. 5. Modifications are those necessary to adapt the system for multiple cylinder operation. Thus, when one of the cylinders has fuel injection pressure applied to it the corresponding switch, e.g. switch 126 is opened. This causes a potential rise to be applied to one side of the capacitor 143 since the network resistance of resistors 132–135 will be increased when one is disconnected. The rise is sufficient to make the transistor 144 conduct and consequently the potential applied to the base of transistor 147 is reduced. Then this will in turn drop the potential applied to the bases of the transistors 147–150 and cutoff their conduction including the final high power transistor 150.

In other words, during steady state conditions, i.e. when no spark signal is called for, the transistor 150 will be conducting and a steady DC current will be flowing in the primary winding 153. Then when one of the injection valves is opened and the fuel is injected, it will open that one of the switches 126–129 which will cutoff the current flow through the transistor 150 and the primary winding 153 in series with it. Consequently, the decaying magnetic flux thus created will generate a high voltage spark signal in the secondary winding 155. This spark signal will be transmitted via the distributor 159 to the proper cylinder and spark plug (not shown).

While particular embodiments of the invention have been described above in considerable detail in accordance with the applicable statutes, this is not to be taken as in any way limiting the invention but merely as being descriptive thereof.

We claim:

1. In combination with an ignition system for an internal combustion engine that employs fuel injection, an ignition coil having a high tension secondary winding for generating spark signals and a low tension primary winding for inducing said generation of spark signals, and circuit means connected to said primary winding for controlling cutoff of a DC current therein, the improvement comprising a fuel injection valve including a needle and having a closed position and an open position, a valve seat adjacent to one end of said needle, means for biasing said needle against said valve seat, means for lifting said needle off said seat when said fuel injection pressure exceeds a predetermined amplitude, said valve needle being electrically conductive, electric circuit means integral with said valve for controlling said DC current cutoff when said valve goes from said closed to said open position, said valve having means for electrically insulating said needle, said electric circuit integral with said valve comprises said valve seat and means for making an electric circuit connection to said needle, and said circuit means connected to said primary winding, also comprises a transistor in series with said primary winding, and additional circuit means including said electric circuit means for controlling said transistor and comprising a plurality of said fuel injection valves connected in parallel.

2. In combination with an ignition system according to claim 1, wherein said additional circuit means comprises a low power transistor and at least one other transistor for coupling said low power transistor to said first named transistor.

3. In combination with an ignition system according to claim 2, wherein said system includes a distributor connected to said high tension secondary winding, and plurality of said valves and electric circuit means one for each cylinder of said internal combustion engine.

4. In combination with an ignition system for an internal combustion engine that employs fuel injection, an ignition coil having a high tension secondary winding for generating spark signals and a low tension primary winding for inducing said generation of spark signals, a distributor connected to said high tension secondary winding, and circuit means connected to said primary winding for controlling cutoff of a DC current therein, said circuit means comprising a fuel injection valve having an electrically conductive needle, an electrically conductive valve seat adjacent to one end of said needle, means for electrically insulating said needle, means for biasing said needle against said valve seat, means for lifting said needle off said seat when said fuel injection pressure exceeds a predetermined amplitude, means for making an electrical circuit connection to said insulated needle, a high power transistor in series with said primary winding, a low power transistor controlled by said needle and valve seat, and at least one additional transistor for coupling said low power transistor to said high power transistor, said circuit means also comprising a plurality of said fuel injection valves one for each cylinder of said engine.

* * * * *